US006041562A

United States Patent [19]

Martella et al.

[11] Patent Number: 6,041,562

[45] Date of Patent: Mar. 28, 2000

[54] COMPOSITE WALL CONSTRUCTION AND DWELLING THEREFROM

[75] Inventors: Vincent Martella, Schomberg; Roberto Calderan; Bernhard Hans Temmler, both of Toronto, all of Canada

[73] Assignee: Mar-Mex Canada Inc., Woodbridge, Canada

[21] Appl. No.: 09/024,656

[22] Filed: Feb. 17, 1998

[51] Int. Cl.[7] ..... E04B 1/02

[52] U.S. Cl. ..... 52/236.7; 52/262; 52/265; 52/275; 52/437; 52/439

[58] Field of Search ..... 52/437, 439, 262, 52/265, 267, 269, 275, 276, 278, 279, 793.11, 794.1, 236.7

[56] References Cited

U.S. PATENT DOCUMENTS

| | | | |
|---|---|---|---|
| 1,436,193 | 11/1922 | Pohlmann et al. | 52/262 |
| 1,757,077 | 5/1930 | Eiserloh | 52/262 |
| 4,565,840 | 1/1986 | Kobayashi et al. | 52/659 |
| 4,687,614 | 8/1987 | Suzuki et al. | 264/40.1 |

*Primary Examiner*—Michael Safavi

[57] ABSTRACT

A construction wall system comprising, an inner rigid panel and an outer rigid panel of rectangular shape and defining length and breadth dimensions and defining side edges on either side and end edges on ends. The panels being spaced apart from one another with plurality of intermediate junction strips secured between the inner and outer panels, in parallel spaced apart relation, at spaced intervals. A plurality of end junction strips are secured between said inner and outer panels adjacent opposite side edges thereof, and spaced inwardly from the side edges to define junction channels along the side edges between the inner and outer panels. A plurality of spacer strips are secured between the inner and outer panels the spacer strips being spaced inwardly relative to the end edges of the panels to define end junction channels between the inner and outer panels. The panels and the strips all being formed of polymer-modified fibre reinforced concrete material with synthetic plastic foam material filling the spaces between the inner and outer panels. The wall structures are formed into a wall by being placed end to end, and by pouring concrete down the edge junction channels of the adjacent wall structures to join them together. Transverse panels are attached to the upper edges of the walls to form a floor, or a roof.

4 Claims, 7 Drawing Sheets

COMPOSITE WALL CONSTRUCTION AND DWELLING THEREFROM

FIELD OF THE INVENTION

The invention relates to a composite wall construction using a plurality of composite wall panels, and to a dwelling constructed from such composite wall panels.

BACKGROUND OF THE INVENTION

Conventional construction of walls involves the erection of framing either of wood or metal. The exterior is then usually covered in with some form of panels and/or bricks or siding. Insulation is placed between the framing and studs, and the interior wall is then covered in usually with plaster board of some kind. It is very well recognized that this involves a large number of different operations, using on site labour, which is paid at relatively high hourly rates. The use of materials on site is also wasteful, in that such materials have to be cut to length and fitted, and the cut off portions are discarded.

Considerable economies can be achieved by the manufacturer of factory built modular housing. Usually however this involves relative complex, repetitive operations. In addition, such pre-fabricated factory built homes are usually built in a relatively complete form with complete walls, doors and windows for the four sides of the dwelling. While this greatly reduces the cost of the housing, the actual fabrication costs still represents a substantial cost of the total house cost.

A partial solution to the problem is to use wall panel systems, in which wall panels can be prefabricated to a standard size, in relative high speed automated factory systems. The panels are then shipped to the site and simply put together to erect the completed walls. Even these systems however suffer from a variety of disadvantages such as the use of various different materials, having differential rates of expansion and contraction, and the use of some materials which may be subject to deterioration, rot, or attack by insects and the like.

Clearly it is desirable to provide for a low cost construction technique in which portions of a building may be pre-built and finished in a factory, and using durable, long lasting materials not subject to attack by rot, weather or insects. It is further clearly desirable that such building components shall be capable of being manufactured by relatively unskilled factory labour, and may be erected to form a low cost dwelling or other building, in a speedy, efficient manner, using a minimum of on-site labour with minimum skills, and requiring only a minimum of heavy equipment. Ideally such a system will require no special form of fastening, or fastening devices or use of specialized tools. The buildings built with this system should be capable of withstanding hurricane and earthquake shocks to a very substantial extent.

BRIEF SUMMARY OF THE INVENTION

With a view to achieving the foregoing advantages the invention provides a construction wall system comprising, an inner rigid panel and an outer rigid panel of rectangular shape and defining length and breadth dimensions and defining side edges on either side and end edges on ends thereof said panels being spaced apart from one another, a plurality of intermediate junction strips having a predetermined width secured between said inner and outer panels, and said junction strips having a length less than the length of said panels, and being arranged in parallel spaced apart relation, at spaced intervals between said inner and outer panels, a plurality of end junction strips having a predetermined width equal to said intermediate junction strips secured between said inner and outer panels adjacent opposite side edges thereof, and spaced inwardly from said side edges whereby to define junction channels along said side edges between said inner and outer panels, a plurality of spacer strips having a predetermined width equal to the width of said junction strips and secured between said inner and outer panels transverse to said junction strips and adjacent thereto, said spacer strips being spaced inwardly relative to said end edges of said panels whereby to define end junction channels between said inner and outer panels, said panels and said strips all being formed of polymer-modified fibre reinforced concrete material.

The invention further comprises a wall construction having a plurality of such wall structures and each said wall structure comprising, inner and outer rigid panels of polymer-modified fibre reinforced concrete material, and means bonding said panels together in spaced apart relation with their planes parallel, junction channels formed along the sides and ends of said wall structure, and, concrete filling in said junction channels between adjacent sides and adjacent ends of said structure said concrete extending integrally from one said junction channel into the adjacent junction channel of two adjacent wall structures.

The invention further comprises a rectangular composite wall structure of the type described, and including a synthetic plastic foam material filling the spaces between said side walls and said end walls and said intermediate junction strips.

The invention provides a plurality of foam filling openings in one of said end walls, whereby foam may be filled into the spaces defined between the intermediate channels after the wall system has been assembled.

The invention further comprises a rectangular composite wall structure as described and wherein said wall construction comprises a plurality of such wall structures erected side by side, and defining a continuous open junction channel at the upper ends of said wall construction, and including concrete filling said continuous open topped junction channel.

The invention further comprises a wall construction as described and including a shallow locating channel formed along the lower edge of each said wall system, and including registering strip means secured to a construction footing, adapted to fit within said shallow registering channel, whereby to register all of said wall systems, and secure their lower ends against movement.

Concrete reinforcing bars of steel may typically be incorporated in the vertical and horizontal junction channels.

The invention further comprises a corner construction consisting of mating interlocking wall panels, formed at adjacent ends with a shorter end edge and a longer end edge, and wherein, when said shorter and longer end edges are placed adjacent one another, they enclose a rectangular enclosure, and concrete received in said rectangular enclosures thereby bonding said wall panels together at said corner.

The invention further comprises a dwelling or other housing structure having walls and a roof and a plurality of wall structures composed of composite wall structures and each said wall structure comprising, inner and outer rigid panels of polymer-modified fibre reinforced concrete material and means bonding said panels together in spaced apart relation with their planes parallel, junction channels formed along the sides and ends of said wall structure, and, concrete filling in said junction channels between adjacent side and adjacent ends of said structure said concrete extending integrally from one said junction channel into the adjacent junction channel of two adjacent wall structures.

The roof preferably comprises a plurality of further roof panels each consisting of upper and lower rigid panels of polymer modified concrete material, and steel reinforcing channels located between said upper and lower panels and bonded thereto, said upper and lower panels and said reinforcing channels defining open spaces therebetween, and concrete material filling said open spaces, and connection means extending upwardly from said walls through said roof, and being secured in said roof panels.

The invention further comprises that said connection means are in the form of generally cone shaped openings formed in said roof panels, and being located and adapted to receive reinforcing bars extending upwardly from said walls, and concrete material filling said cone shaped recesses and bonding around said reinforcing bars and securing said roof in position.

Preferably the roof will be comprised of a plurality of relatively narrow roof panels, each of the roof panels having interlocking male and female formations at their respective side edges, whereby said roof panels may be mated together, to form a roof spanning the space of a building.

The invention further comprises a method of constructing a wall panel structure having the foregoing advantages, and a method of constructing walls, and a dwelling using the wall structures according to the foregoing.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
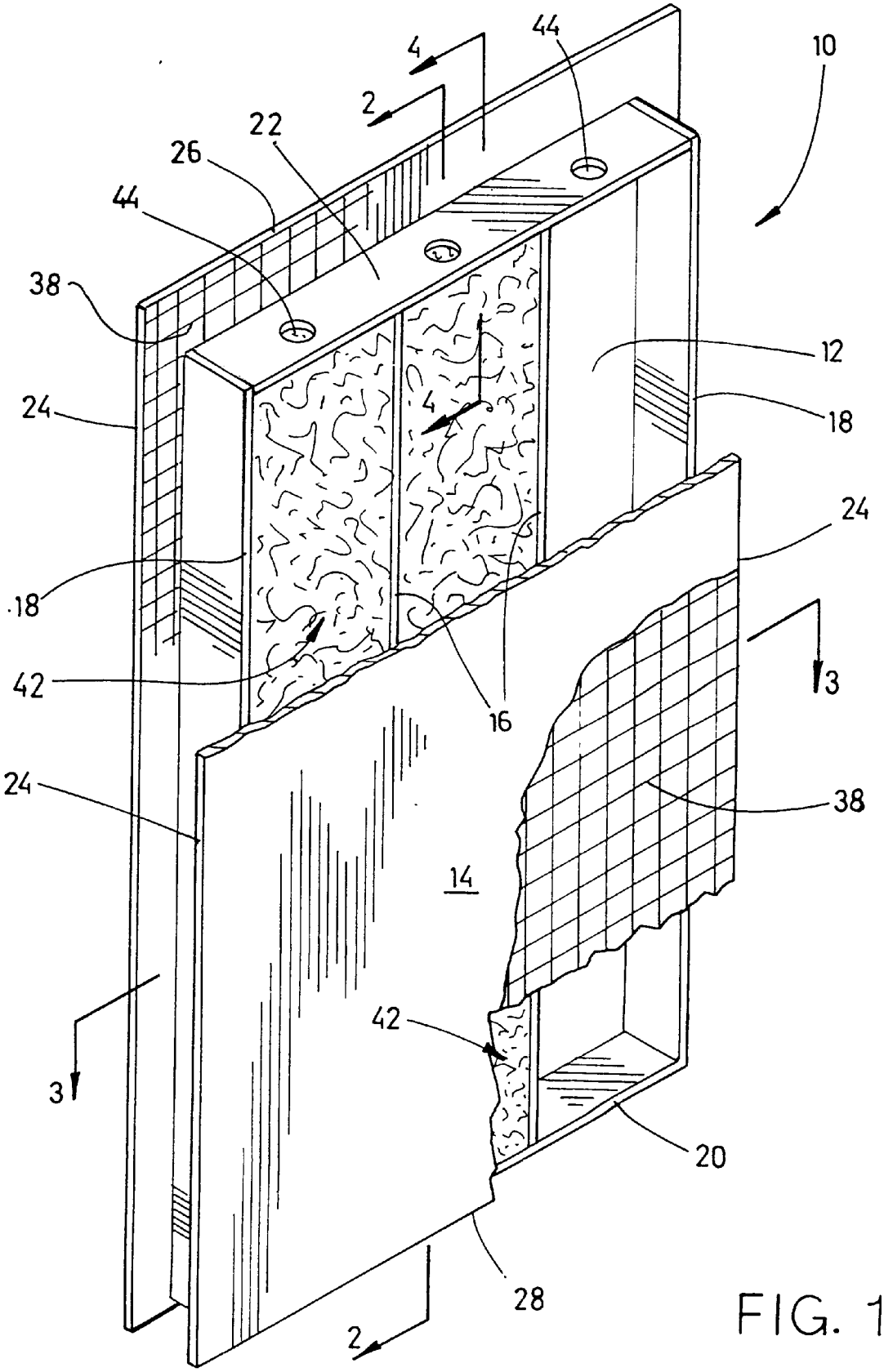
FIG. 1 is a perspective illustration partially cut away of a composite wall structure manufactured as illustrating one form of the invention.

As already indicated the invention relates generally to a composite wall structure, which is modular in nature and which is factory built. The modular wall structure can be transported in large numbers to a building site and then can be erected basically by hand labour, and using simple poured concrete facilities.

The basic wall structure is illustrated in FIGS. 1 through 4. It will be seen to comprise a modular wall structure illustrated generally as 10. The wall structure 10 has an outer panel 12 and an inner panel 14. They are both of rectangular shape and of identical size, and typically may be in the region of four feet by eight feet, or more depending upon the height of the dwelling, or other building to be erected.

Panels 12 and 14 are spaced apart from one another, and are secured to one another by means of intermediate vertical junction strips 16, and end junction strips 18. The junction strips 16 and 18 are arranged parallel and spaced apart, and on a vertical orientation, similar to vertical studs in a typical wall structure.

In the illustration of FIG. 1, there will be seen to be two intermediate vertical junction strips and two end vertical strips, but the number and spacing of such vertical strips will depend upon the function and design for which the wall structure is intended, and the numbers shown are not intended to be in any way limiting of the invention.

A plurality of spacer strips, in this case a lower spacer strip 20 and an upper spacer strip 22 are provided. The spacer strips extend transversely of the panels 12 and 14, and close off the open ends of the vertical junction strips 16 and 18, providing a closed honeycomb box structure between the panels 12 and 14.

It will be noted that the end junction strips 18—18 are spaced inwardly relative to the side edges 24 of the panels 12 and 14. The spacer strips 20 and 22 intersect and contact the ends of the junction strips 16 and 18. The upper ends of the junction strips 16 and 18 terminate short of the upper edge 26 of the panels 12 and 14, and the lower ends of the junction strips 16 and 18 terminate short of the lower edges 28 of the panels 12 and 14.

Figure 2:
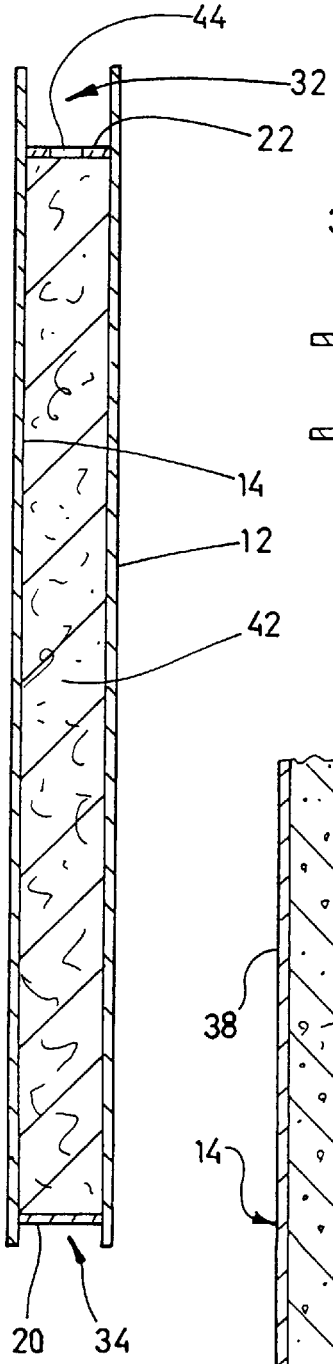
FIG. 2 is a section along the line 2—2 of FIG. 1.
Figure 3:
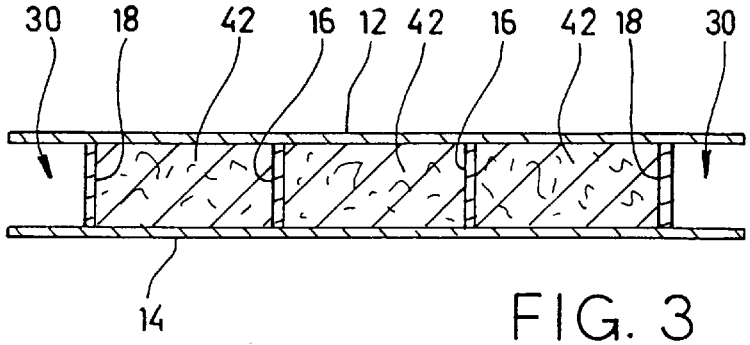
FIG. 3 is a section along the line 3—3 of FIG. 1.

Referring more particularly to FIGS. 2 and 3, it will be seen that along either side of the composite wall structure, and along the top edge, there are defined a generally open sided rectangular vertical channels 30—30 and a horizontal channel 32. Along the lower edge of the wall structure there is defined a shallow lower rectangular channel 34 which it will be seen, is of reduced depth dimension in relation to the channels 30 and 32.

Figure 4:
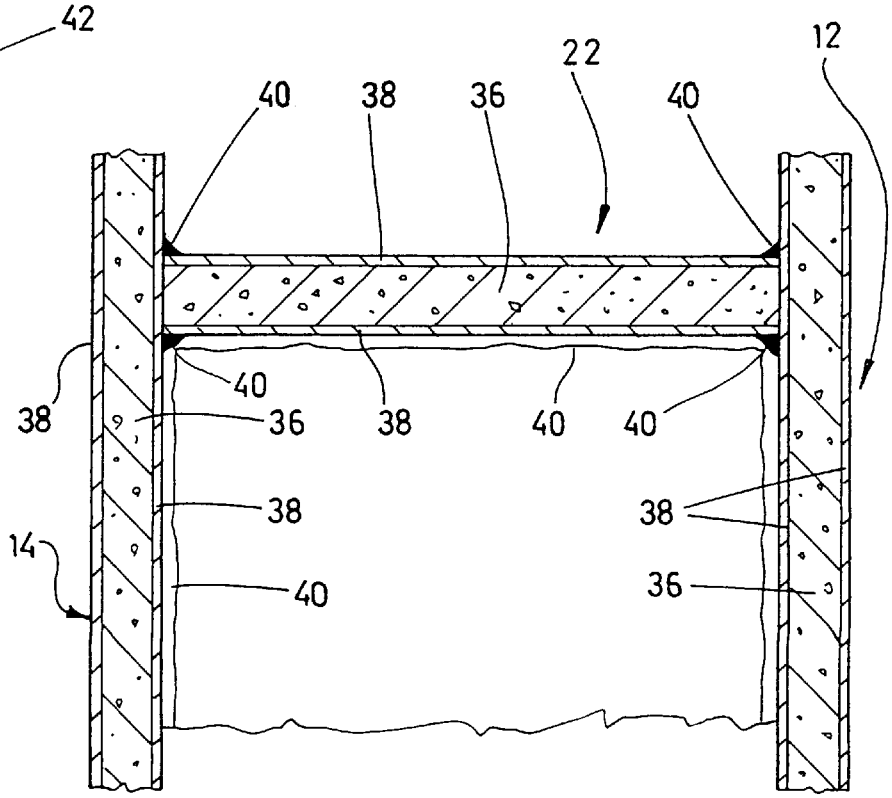
FIG. 4 is a section along the line 4—4 of FIG. 1 greatly enlarged to show the method of bonding the portions of the composite wall structure together.

Referring now to FIG. 4, each of the panels 12 and 14, and the junction strips 16 and 18 and the end strips 20 and 22 are all of identical construction. They will seen to comprise first and second sheets 36 and 38 of polymer-reinforced concrete material, typically having a thickness of about one half to three quarters of an inch. On either side of the polymer-reinforced concrete material, there are located fibre reinforced matting sheets 38—38. Such sheets of polymer-reinforced concrete, reinforced with fibre matting, typically resin fibre matting, forms a structure of great strength and bending resistance and load carrying capacity.

The junction strips 16 and 18 and the end strips 20 and 22 are bonded to the interior of the inner and outer panels 12 and 14 by any suitable adhesive means indicated generally as 40 (FIG. 4).

The spaces defined between the front and rear panels 12 and 14, and the junction strips 16 and 18 and the end strips 20 and 22 are filled with foam insulation material, typically polyurethane foam material. Such foam material is indicated generally as 42 in the Figures. The foam is not shown in FIG. 4 for the sake of simplicity.

The upper end strips 22 are provided with end openings 44, through which nozzles may be inserted (not shown) for the injection of foam materials.

Once such foam materials have set, they will bond securely to the inner surfaces of the panels 12 and 14, defined by the fibre resin mesh reinforcement 38, thereby bonding the panels 12 and 14 and the junction strips and end strips together to make a homogenous integral solid wall structure.

All of these functions can be carried out in the factory with great precision, and also with a minimum of instruction. The wall structures 10 being largely formed of foam material are relatively light, and can be handled by manual labour without the use special mechanical lifting devices.

Figure 5:
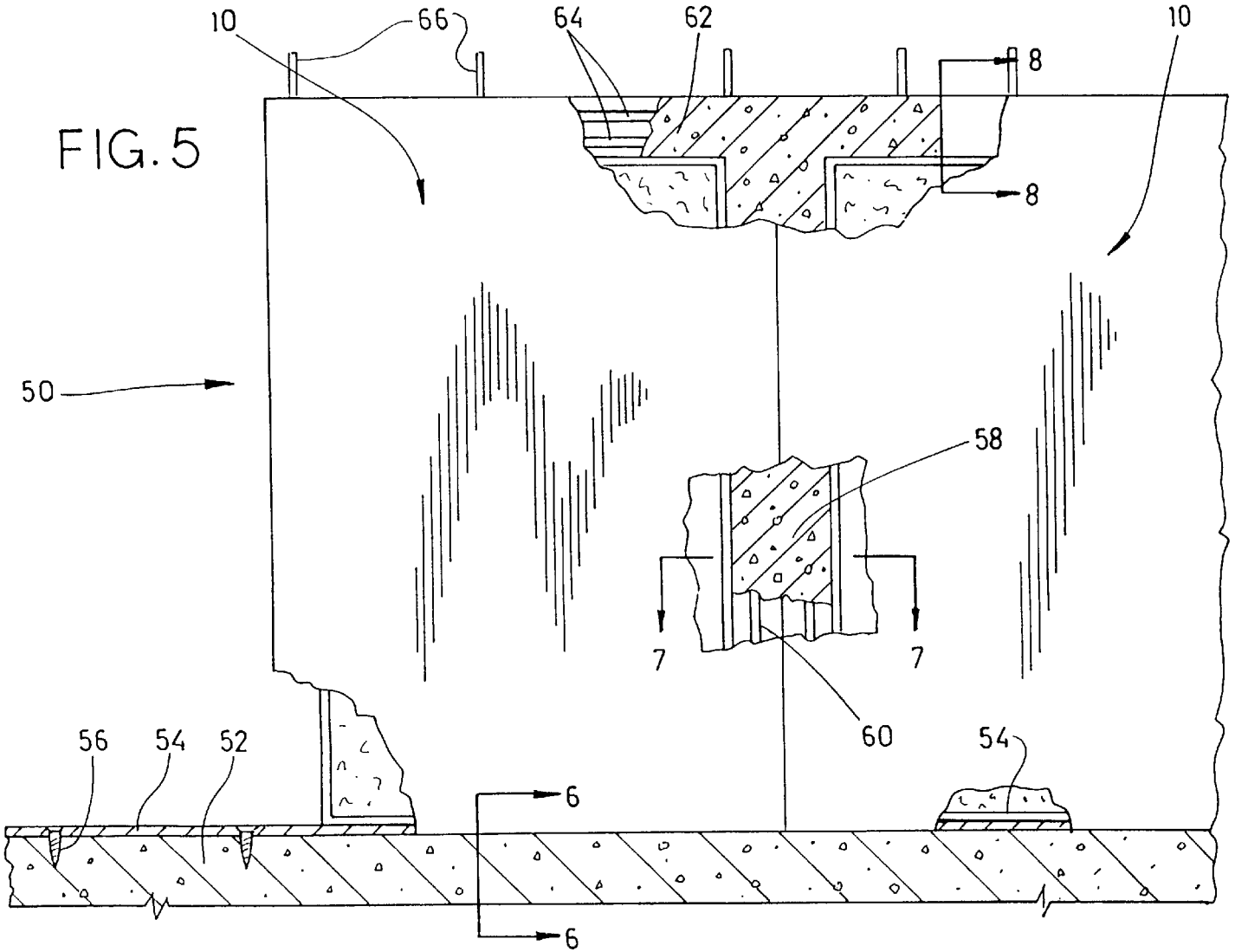
FIG. 5 is a side elevational view partially cut away showing two composite wall structures erected on a concrete foundation, and showing them assembled together using poured concrete as the joining medium.
Figure 6:
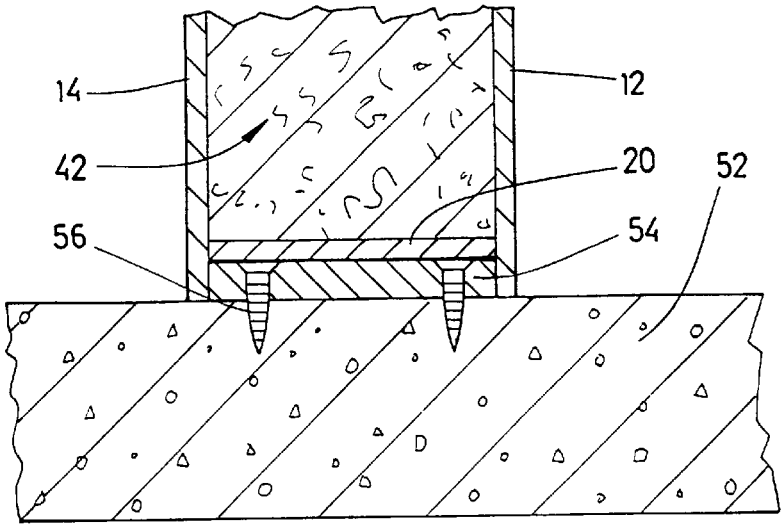
FIG. 6 is a section along the line 6—6 of FIG. 5.
Figure 7:
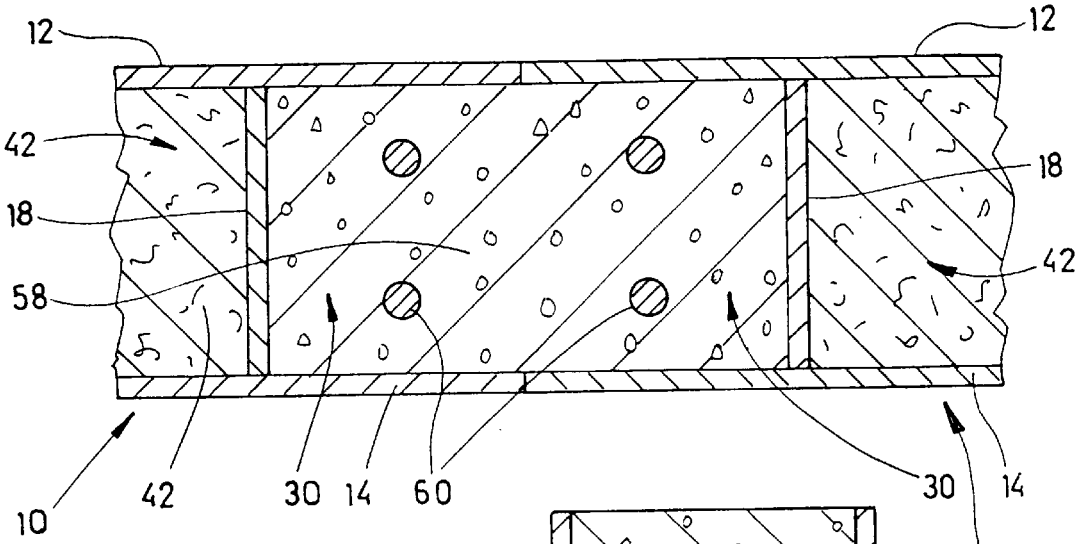
FIG. 7 is a section along the line 7—7 of FIG. 5.
Figure 8:
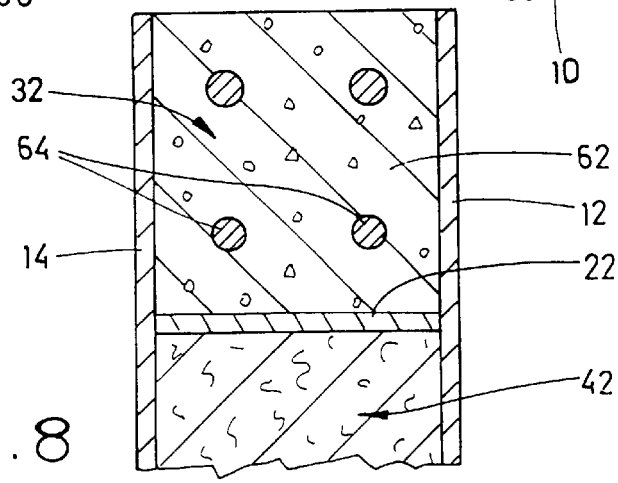
FIG. 8 is a section along the line 8—8 of FIG. 5.

Referring now to FIGS. 5, 6, 7 and 8, the wall structures 10 can be associated together to form a wall shown generally as 50 in FIG. 5. The wall 50 illustrated in FIG. 5 is merely illustrative of the way in which the wall structures 10 can be used to be construct and erect a wall. Typically the wall of a single storey building or dwelling, will be defined by the height, i.e. the length dimension of each panel 10. As shown in FIG. 5, the panels 10 are erected on a concrete base or slab or foundation indicated as 52. In order to locate the wall structures 10, a locating strip 54 is secured on the surface of the slab 52 by nails or other fastenings 56. The locating strip 54 in this embodiment is typically formed by a strip of the polymer-reinforced concrete panel material 58 used in the front and rear panels 12 and 14 and the junction strips 16, 18, 20 and 22. It is cut to the spacing between the front and rear panels 12 and 14.

The lower channel 24 (FIG. 2) is arranged so that it has a sufficient height to fit over the locating strip 54, and make a snug fit thereon.

In order to join the two wall structures 10—10 together, in edge to edge abutting relation, concrete material 58 is poured down through the channels 30—30, between two adjacent structures 10—10. It may be that some additional bracing is temporarily required adjacent the joints between the panels 12 and 14 of the adjacent wall structures 10—10, and this of course may be provided in any suitable manner (not shown) for example by means of wooden planks, or metal bracing sheets or the like. Such temporary bracing may be required in order to prevent the pressure of the concrete from distorting the edges of the panels 12 and 14 where they define the channels 30—30. However, the bracing can usually be removed after twenty-four hours as the concrete material 58 cures.

Usually, there will be a plurality of vertical of reinforcing rods 60 will be placed in the channels 30—30 prior to pouring of the concrete, in accordance with well known construction techniques.

In order to provide a horizontal top beam, for supporting the roof (not shown) further concrete 62 is poured in the channels 32 lying along the top of the wall structures 10—10. Generally speaking, since the depth of this concrete is only a few inches, there will be no additional bracing required at this point.

Such concrete beam 62 will usually be reinforced with suitable reinforcing rods 64. When the wall is finished, the individual wall structures 10 are joined edge to edge in abutting relation, and the wall is supported by vertical columns of cured concrete 58, and by horizontal beams of concrete 62, which are all poured integrally at the same time and form a structure of great strength. Additional rebars 66 may be placed at intervals extending vertically upwards for attachment of a roof.

Figure 9:
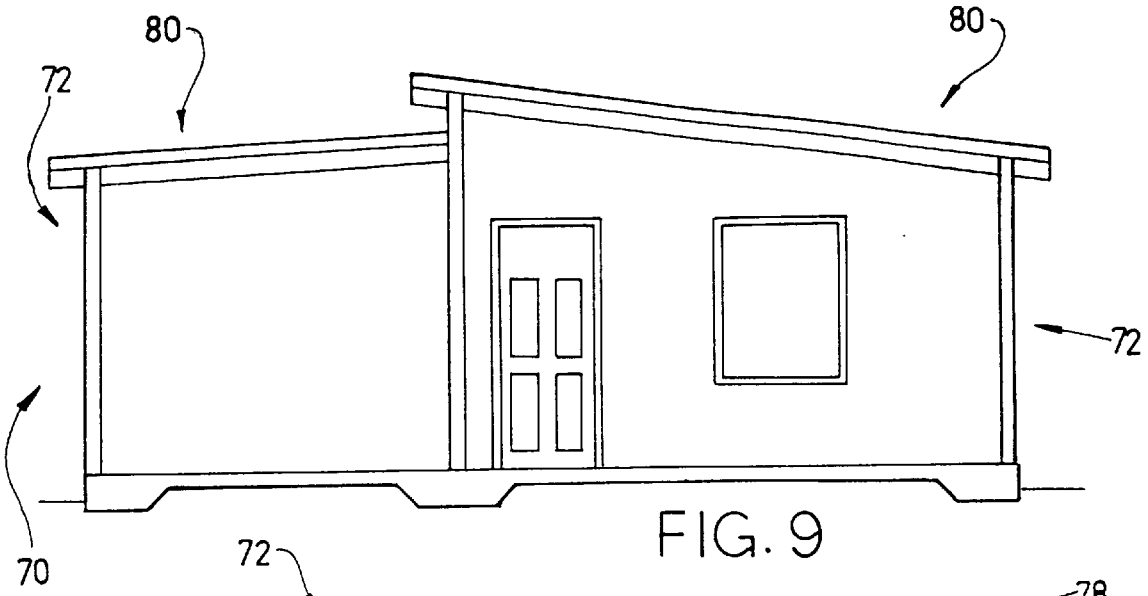
FIG. 9 is a schematic side elevational view of a simple dwelling illustrating the use of the invention in construction.
Figure 10:
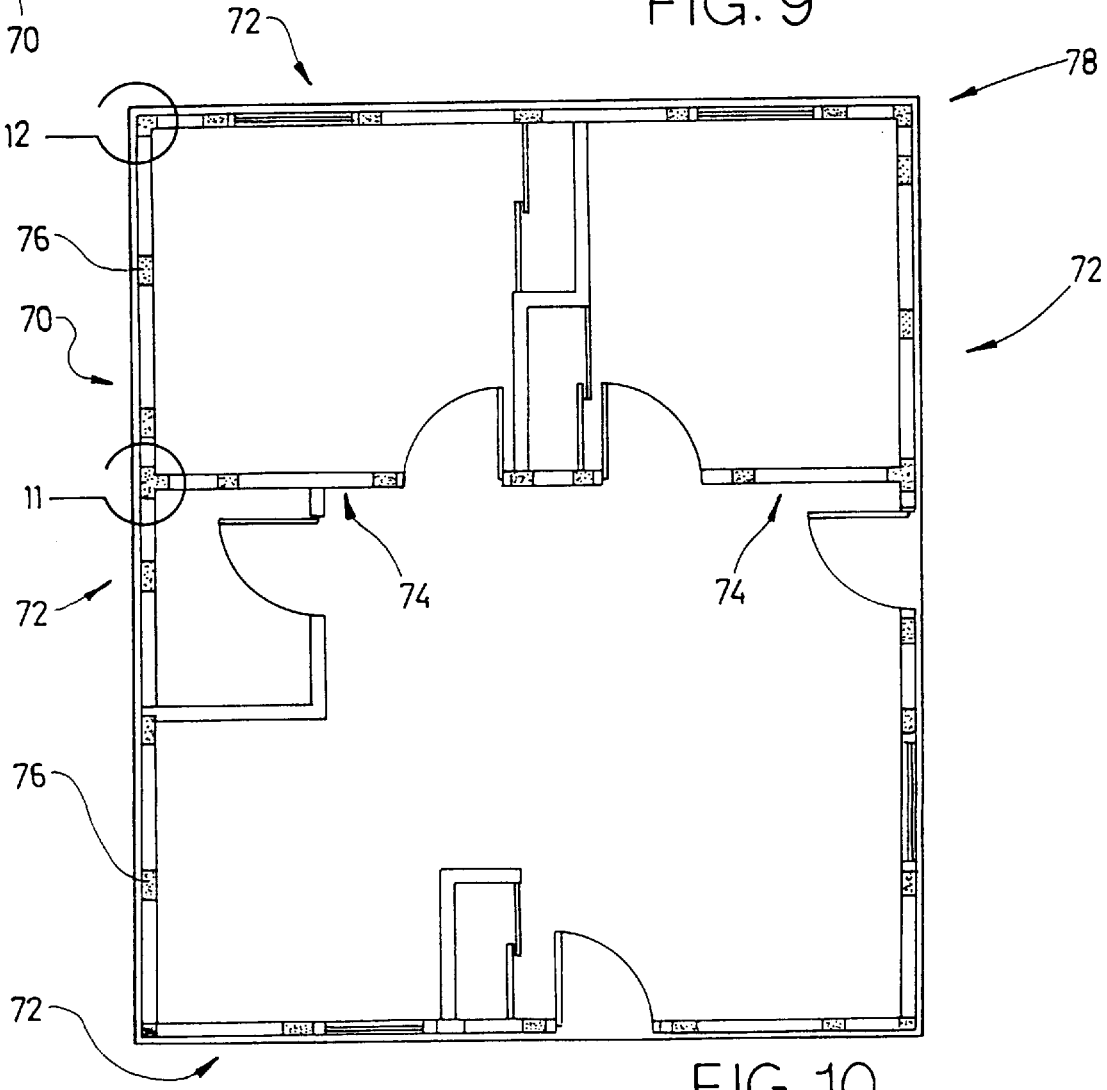
FIG. 10 is a top plan view of the building plan of the dwelling of FIG. 9.
Figure 11:
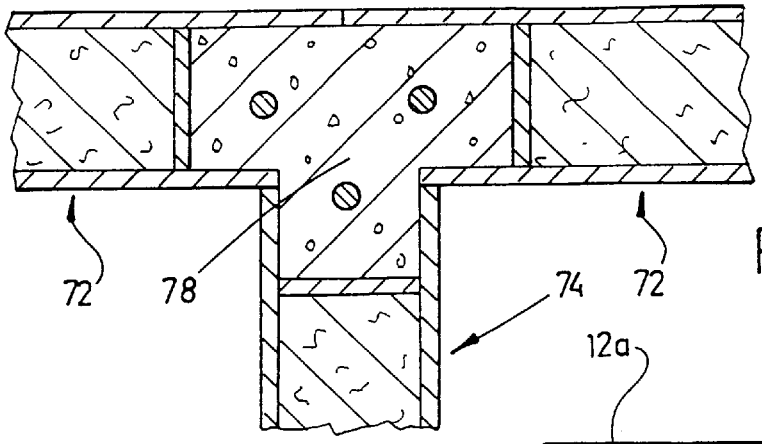
FIG. 11 is a section along the line 11—11 of FIG. 10 greatly enlarged showing the method of joining side walls and a partition wall together at a Tee junction.

It will now be apparent from the foregoing description that the wall structures can be assembled together to provide walls for a dwelling or other building, and referring now to FIGS. 9, 10 and 11, such a building is illustrated generally as 70. FIG. 9 is a schematic side elevation of such a building, typically a small, low cost dwelling, and FIG. 10 is a floor plan of such a building.

It will be seen that the building 70 is provided with four exterior walls 72—72, and a central partition wall 74, extending between two of the side walls. All of the walls 72 and 74 are made of wall structures as described in FIGS. 1 through 8, and all of the wall structures are joined by means of poured concrete columns. In FIG. 10 the poured concrete joining columns are indicated as 76. The junction between the side walls 72 and the partition walls 74 is achieved by means of a generally Tee-shaped poured concrete column 78, illustrated in more detail in FIG. 11. Portions of the inner panels 14 of two abutting wall panels may be cut away as shown to allow concrete to flow into the Tee junction.

Figure 12:
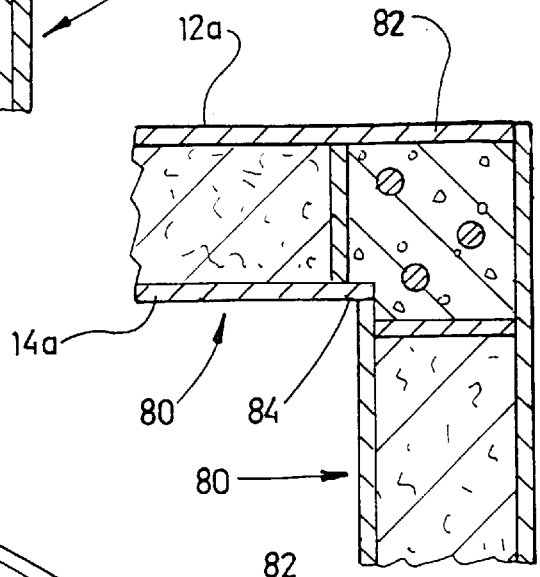
FIG. 12 is a section along the line 12—12 of FIG. 10, greatly enlarged, and showing the method of joining two side walls at a right angular corner, and providing for a generally rectangular vertical concrete column to be enclosed therein.
Figure 13:
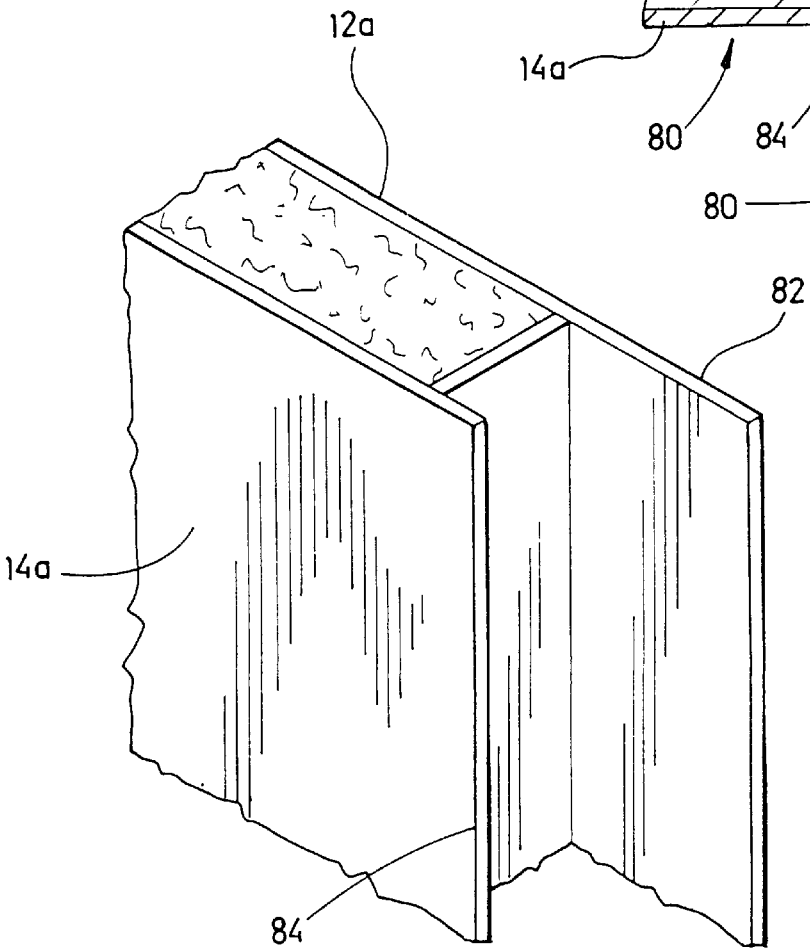
FIG. 13 is a perspective illustration of a side panel suitable for forming a corner as shown in FIG. 12.

The corners of the walls in this embodiment require modified wall structures indicated as 80 (FIGS. 12 and 13).

These modified wall structures 80 are formed with outer panels 12A which are extended somewhat along one edge as at 82, and have modified interior panels 14A, which are cut somewhat shorter as at 84.

Two wall structures 80 as shown, may be formed into a corner by placing the longer and shorter edges 82 and 84 in edge abutting relation as shown in FIG. 12. This forms a right angular corner. Suitable reinforcing rods (not shown) will be inserted down the L-shaped space defined by the longer and shorter portions 82 and 84, and concrete can be poured down in the space. The concrete will form a generally L-shaped column, extending around the corner, and holding both wall structures securely together and holding them upright.

FIG. 10 also illustrates doorways, windows and the like formed in the structure, and supported on either side by additional concrete columns, which are unreferenced, since they are self-evident from the foregoing description.

At this point, reviewing the simple dwelling structure of FIGS. 9 and 10 it will be seen that the four walls and the central partition wall are all constructed of the composite wall structure as illustrated generally in FIG. 1, and that they are joined edge to edge to form the complete walls by means of poured concrete columns. The entire structure thus has great integral strength, and at the same time has great resistance to thermal transmission. Being provided with a plurality of vertical supporting concrete columns, reinforced as described, the structure will have great resistance to earthquake and other shocks. At the same time it is apparent that it can readily be erected, by manual labour simply taking the wall structures illustrated in FIG. 1 and FIG. 13 and erecting them side by side and corner to corner, supporting them vertically, and pouring concrete using relatively primitive equipment such as will be readily available even in remote locations.

Reference may now be made to the roof 90 of the dwelling.

Figure 15:
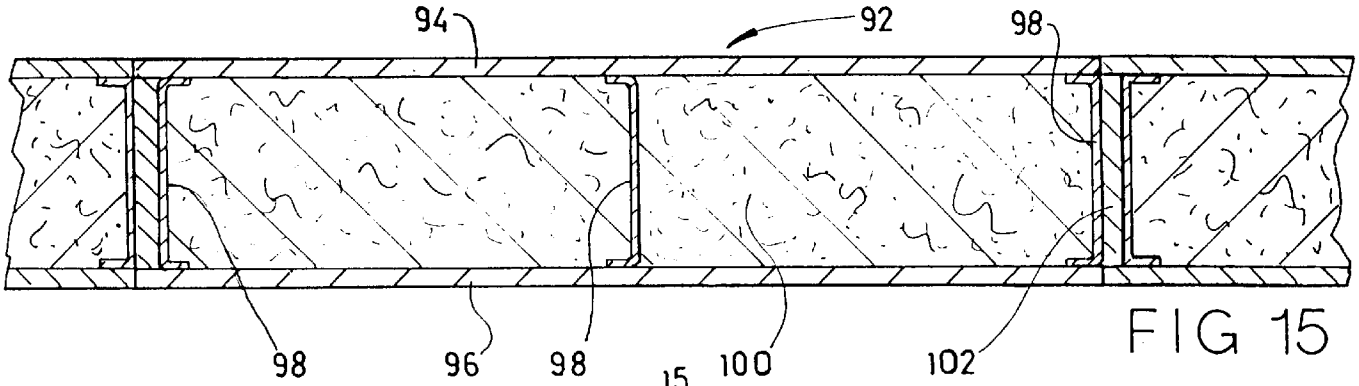
FIG. 15 is a section along the line 15—15 of FIG. 14 illustrating the construction of a plurality of roof panels placed edge to edge in interlocking mating relation.
Figure 14:
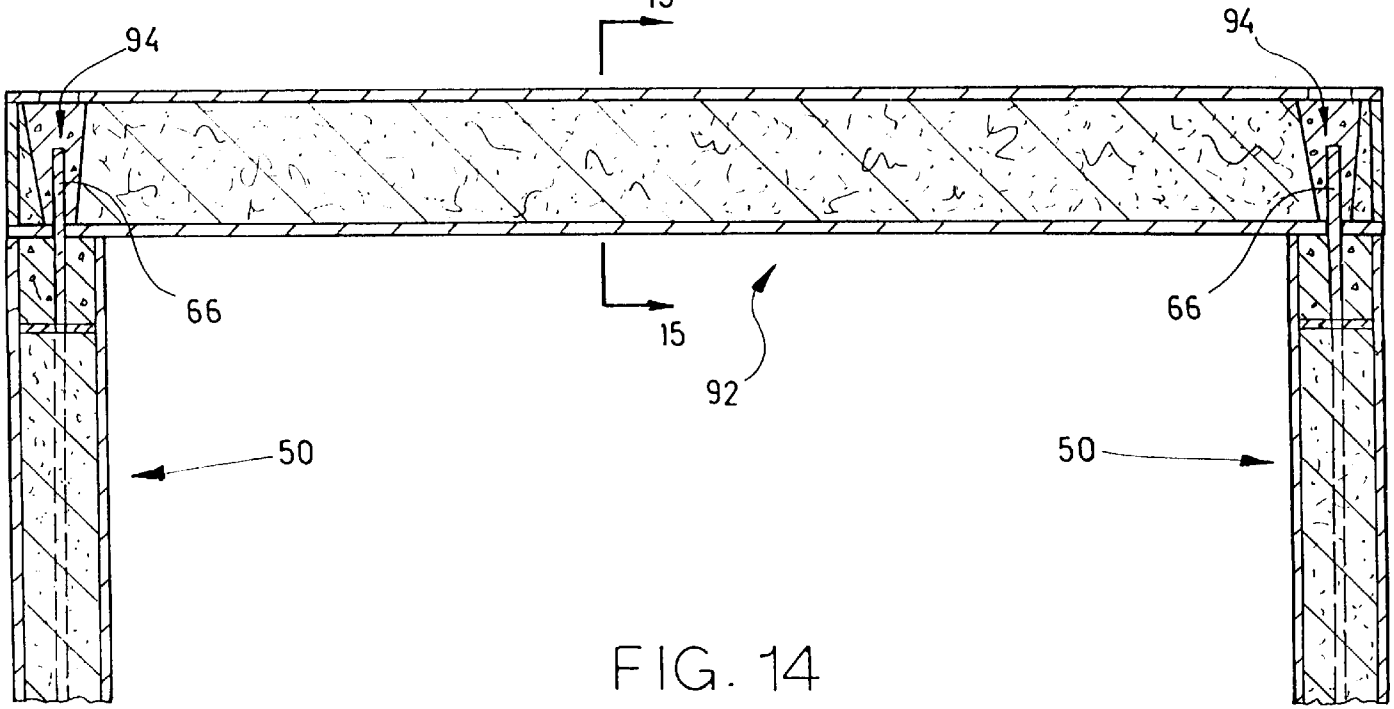
FIG. 14 is a sectional illustration along the line 14—14 of FIG. 9, illustrating the attachment of a roof panel, to two upright walls.

The roof is best illustrated in FIGS. 14 and 15. It will be made up of a plurality of elongated relatively narrow roof members 92. The roof members 92 comprise upper and lower panels 94 and 96 formed of polymer modified concrete. A plurality of steel reinforcing channels 98—98—98 are bonded between the interior surfaces of the panels 94 and 96. Panels 94 and 96 are otherwise formed in the same way, with reinforcing fibre glass mesh, as described in connection with the panels of FIG. 1.

Between the reinforced C sections, the spaces between the panels are filled with foam plastic indicated generally as 100.

Along one side edge of each of the roof members 92, the C section 98 is recessed inwardly between the panels 94 and 96 so as to leave a shallow channel. Along the other side edge of the member 92, the C section 98 is flush with the ends of the panels 94 and 96. A mating strip member 102 is bonded to the exterior of the C section 98, and is dimensioned so as to make a snug fit between the space left by the panels 94 and 96 along the other side edge.

In this way the roof members 92 can be butted together in a form of tongue and groove interconnection.

In order to secure the roof members 92 to the walls 50, the vertically extending rebars 66 are located and dimensioned so as to interfit with generally conically shaped recesses 104, formed at each end of each of the roof members 92.

With this arrangement, concrete is then filled in around the conical recess 94 bonding to the rebars 66 and holding the roof firmly in position.

Similar arrangements can be made for the pitched roof shown in FIG. 10, the details of which require no special description.

It will also be understood that, in a two storey structure, the members 92 will serve as the floor of the second storey, and will be secured in the same way.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A dwelling or other housing structure having a plurality of wall structures and a transverse covering each said wall structure comprising;

inner and outer rigid panels of polymer-modified fibre reinforced concrete material and means bonding said panels together in spaced apart relation with their planes parallel;

junction channels formed along the sides and ends of said wall structure; and, concrete filling in said junction channels between adjacent side and adjacent ends of said wall structure said concrete extending integrally from one said junction channel into the adjacent junction channel of two adjacent wall structures;

and said transverse covering comprising a plurality of transverse panels, each consisting of upper and lower rigid panels of polymer modified concrete material, and steel reinforcing channels located between said upper and lower panels and bonded thereto, said upper and lower panels and said reinforcing channels defining open spaces there between, and foam plastic material filling said open spaces, and, connection means extending upwardly from said wall structures through said transverse covering, and being secured in said transverse panels.

2. A dwelling structure as claimed in claim 1, wherein said connection means are in the form of generally cone shaped openings formed in said transverse panels, and being located and adapted to receive reinforcing bars extending upwardly from said structures, and concrete material filling said cone shaped recesses and bonding around said reinforcing bars and securing said transverse covering in position.

3. A dwelling structure as claimed in claim 2 and including a plurality of relatively narrow transverse coverings, each of the transverse coverings having side edges and interlocking male and female formations at their respective side edges, whereby said transverse coverings may be mated together, to form a transverse structure spanning the space of a building.

4. A dwelling structure as claimed in claim 3 wherein said transverse coverings form a floor for a second storey of said dwelling structure.

* * * * *